United States Patent [19]

Takahashi

[11] 4,391,305

[45] Jul. 5, 1983

[54] WEFT PICKING DEVICE OF AIR JET TYPE WEAVING LOOM

[75] Inventor: Takao Takahashi, Hachioji, Japan

[73] Assignee: Nissan Motor Co., Ltd., Yokohama, Japan

[21] Appl. No.: 149,083

[22] Filed: May 12, 1980

[30] Foreign Application Priority Data

| | | | |
|---|---|---|---|
| May 18, 1979 | [JP] | Japan | 54-61767 |
| Oct. 19, 1979 | [JP] | Japan | 54-134242 |
| Jan. 14, 1980 | [JP] | Japan | 55-2121 |

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,818,952 | 6/1974 | Vermeulen et al. | 139/435 |
| 3,958,609 | 5/1976 | Zollinger et al. | 139/435 |
| 4,031,926 | 6/1977 | Zollinger et al. | 139/435 |
| 4,183,382 | 1/1980 | Scheffel | 139/435 |
| 4,244,402 | 1/1981 | Hasegawa et al. | 139/435 |

FOREIGN PATENT DOCUMENTS

| | | | |
|---|---|---|---|
| 2600369 | 7/1977 | Fed. Rep. of Germany | 139/435 |
| 2622148 | 11/1977 | Fed. Rep. of Germany | 139/435 |
| 47-7576 | 4/1972 | Japan | 139/435 |
| 49-47661 | 5/1974 | Japan | 139/435 |
| 52-49361 | 4/1977 | Japan | 139/435 |
| 533705 | 9/1971 | Switzerland | 139/435 |
| 2022630 | 12/1979 | United Kingdom | 139/435 |

*Primary Examiner*—Henry Jaudon

*Attorney, Agent, or Firm*—Thompson, Birch, Gauthier & Samuels

[57] ABSTRACT

A weft picking device of an air jet type weaving loom including a weft inserting nozzle, a plurality of air guide members which form an air guide channel through which a weft yarn from the weft inserting nozzle is picked into the shed of warp yarns, and an auxiliary nozzle disposed between a pair of adjacent air guide members and formed with a small nozzle opening through which auxiliary air is ejected, the nozzle opening being so located that the extension of the axis thereof intersects the axis of the air guide channel at an angle lying within a plane containing the axes of the nozzle opening and the air guide channel, thereby achieving effective weft picking and overcoming the drawbacks encountered in various conventional weft picking devices.

15 Claims, 29 Drawing Figures

36b
36a
4a
36d
6
4d
4c
2
36
36c
S
1
17
4b
18
16
15
4
2a
12
7
8
11

WEFT PICKING DEVICE OF AIR JET TYPE WEAVING LOOM

BACKGROUND OF THE INVENTION

This invention relates to a weft picking device for an air jet type shuttleless weaving loom, including a plurality of air guide members forming an air guide channel therethrough so as to carry out weft picking by guiding and carrying a weft yarn inserted by a weft inserting nozzle or main nozzle under the influence of an air jet, and more particularly to the a weft picking device which is provided with an auxiliary nozzle for assisting the weft picking operation along the air guide channel.

In connection with most air jet type weaving looms, conventionally used weft picking devices and particularly weft carrying devices thereof, are divided broadly into two kinds.

The first kind of device is disclosed in Japanese Patent Provisional Publication No. 47-7576, in which a plurality of auxiliary nozzles, each having a nozzle opening, is provided at a side of an air guide channel through which a weft yarn passes to be picked, the air ejection line from the nozzle opening being directed so as to be substantially parallel with the moving direction of the picked weft yarn. Additionally, in such a device, the following measures are necessary and adapted in order to prevent the picked weft yarn from deviating from a scheduled line: (1) an air guide member of U-shape having a groove which is closed in three directions is disposed at a plurality of locations as disclosed in the above-mentioned Japanese Patent Provisional Publication; (2) such a groove is formed at the dent section of a reed; and (3) the scheduled line for weft picking is so directed as to positively introduce the picked weft yarn into the above-mentioned groove. With such a weft inserting device, at about the time when the leading end of a picked weft yarn injected from a main nozzle under the action of an air jet ejected from the main nozzle reaches the front-most auxiliary nozzle, an auxiliary air jet is ejected from an auxiliary nozzle to blow up the leading end of the picked weft yarn in the direction of weft picking. This operation is carried out in turn by succeeding auxiliary nozzles to achieve weft picking.

As will be understood, the method of weft picking of such a weft picking device is suitable for a weaving loom for weaving a wide fabric. However, this method for weft insertion has encountered difficulties in which the air jet from the main nozzle is spread immediately after air ejection from the auxiliary nozzle, and accordingly the air jet from the main nozzle is almost not used to carry the weft yarn along the air guide channel, wasting expensive pressurized air.

The second kind of device for weft picking is provided with an air guide channel which is constructed with air guide members which are aligned relatively close to each other. Each air guide member is formed into a generally circular shape, leaving an air guide opening which is tapered in the direction of weft insertion. With this arrangement, air ejected from a main nozzle advances within the air guide channel receiving a converging effect from the tapered surface of the air guide opening, even after the air ejected from the main nozzle completes the drawing and dispatching actions to the weft yarn. It will be understood that the weft yarn injected from the main nozzle is carried by the action of the air stream produced as described above.

According to the method of the above-mentioned second kind of weft picking device, although the ejected air from the main nozzle is effectively used for carrying the weft yarn through the air guide channel and accordingly operation and equipment costs are reduced, it is unavoidable that the advancing air flow stream gradually leaks out of each clearance between the adjacent air guide members and out of a slit of the air guide member through which slit a weft yarn escapes. Hence, this weft picking device has encountered the drawback in which the intensity of the air stream becomes insufficient at a side of the loom, opposite to a side provided with the main nozzle.

In order to overcome this drawback, it will be appreciated that an auxiliary nozzle is installed to compensate for the above-mentioned air leaks and to intensify the air stream. For this purpose, it is necessary not to disturb the the main air stream from the main nozzle by the air jet ejected from the auxiliary nozzle, which has been already disclosed in Japanese Patent Provisional Publication Nos. 49-47661 and 52-49361. In the weft insertion devices shown in these publications, the auxiliary nozzles are formed as parts of the air guide members. Accordingly, these auxiliary nozzles are constructed with a plurality of circular or slit-like nozzle openings which are formed immediately outside and in the vicinity of the air guide opening of the air guide member, which nozzle openings are located symmetrically with each other relative to a point. These nozzle openings are directed to a point which lies downstream of the nozzle openings in the scheduled weft picking path, so that a high speed air jet from the nozzle openings of the auxiliary nozzles are added uniformly from around the air guide channel to the air stream in the air guide channel. Since the nozzle openings of the auxiliary nozzles are symmetrically are located relative to a point, the shape of the entire body necessarily becomes annular. Furthermore, the auxiliary nozzle must act with the air guide members so as to push aside the warp yarns to enter the shed and then withdraw from the shed. In this regard, th outer shape of the auxiliary nozzle should be the same as that of the air guide member. It will be understood from this that the auxiliary nozzle is formed as part of the air guide member.

Now, it is to be noted that the thickness of the air guide member is normally limited approximately to 2 to 3 mm, and accordingly when a flow pass for ejection air is formed inside of the air guide member and air introduction paths are branched off from the flow pass to air ejection nozzle openings, the sectional areas of these paths and the lengths of the air introduction paths are considerably limited. This unavoidably results in differences in air ejection speed, air ejection amount, and air ejection direction, among a plurality of nozzle openings. As a result, the air stream of the air guide channel is disturbed by the air ejections from the nozzle openings formed at the air guide member, by which an effective weft picking becomes impossible.

Hence, the above-mentioned second kind of device for weft picking seems undesirable from the standpoint of preventing the air stream in the air guide channel from being disturbed, i.e., directing always the air stream line from the nozzles openings of auxiliary nozzle along the weft picking path. In view of the above, the purpose of this invention was to achieve a desirable weft picking by employing a simple auxiliary nozzle which is similar to that of the above-mentioned first device for weft picking, in which the simple auxiliary air stream from the auxiliary nozzle is added angularly to a main air stream in the air guide channel so as to guide and assist the main air stream, and further to immediately recover the main air stream into a normal state under the action of the auxiliary air stream which repeats the main air stream's reflection on the opposite inner surfaces of the air guide members, if the main air stream is once disturbed.

SUMMARY OF THE INVENTION

According to the present invention, in a weft picking device of an air jet type weaving loom equipped with a weft inserting nozzle, and a plurality of air guide members which form an air guide channel through which a weft yarn is picked into the shed of warp yarns, an auxiliary nozzle is disposed between a pair of adjacent air guide members and formed with a small cylindrical nozzle opening though which auxiliary air is ejected. The auxiliary nozzle opening is so located that the extension of the axis thereof intersects the axis of the air guide channel at a predetermined angle lying in a plane containing the axes of the auxiliary nozzle opening and the air guide channel. The extension of the axis of the auxiliary nozzle opening reaches a point on the inner peripheral suface of the air guide member which is positioned farther than the auxiliary nozzle relative to the weft inserting nozzle.

A main object of the present invention is to provide an improved weft picking device of an air jet type weaving loom, which effectively achieves weft picking through an air guide channel formed by a plurality of air guide members, overcoming the drawbacks encountered in various weft picking devices of air jet type weaving looms.

Another object of the present invention is to provide an improved weft picking device of an air jet type weaving loom, which is suitable for weaving a wide fabric and is economical in operation cost.

A further object of the present invention is to provide an improved weft picking device of an air jet type weaving loom, in which a main air stream from a weft inserting nozzle is assisted by an auxiliary air stream which is ejected from an auxiliary nozzle in such a direction as to intersect the axis of an air guide channel formed by a plurality of air guide members.

Other objects, features, and advantages of the improved weft picking device according to the present invention will be apparent from the following description taken in conjunction with the accompanying drawings wherein the like reference numerals designate the like parts and elements.

DETAILED DESCRIPTION OF THE PREFERRED EMBODIMENTS

Figure 1:
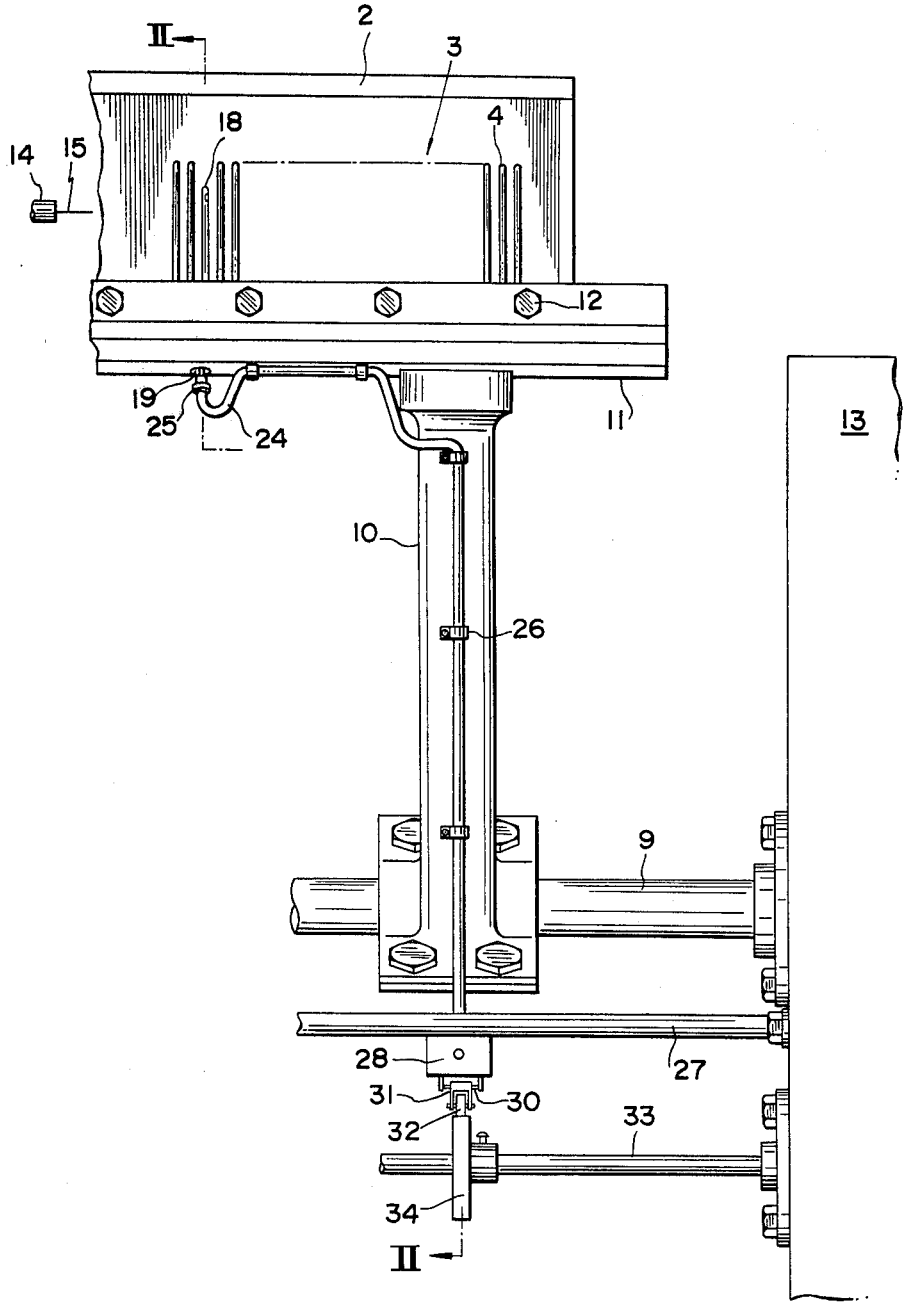
FIG. 1 is a front view of a first embodiment of a weft picking device according to the present invention, in cooperation with an air jet type weaving loom.

Referring now to FIGS. 1 to 6 of the drawings, there is shown a first embodiment of a weft picking device for an air jet type weaving loom, in accordance with the present invention, which picking device accomplishes weft picking into a shed S formed by raised and lowered warp yarns 1. The weaving loom comprises a reed 2 which automatically pushes or beats up each filling yarn against a portion of a fabric which has already been formed. An air guiding device 3 is constructed by a plurality of air guide members 4 which includes a vertically elongate section 4*a*, and a curved section 4*b* which is branched off from but integral with the elongate section 4*a*. The elongate and curved sections 4*a* and 4*b* of the air guide member 4 form a generally circular air guide opening 5 and a slit 6 through which a yarn gets out of the air guide opening 5. The reference numeral 4*c* denotes a flexible tongue-like member which is formed integral with the inner surface of the curved section 4*b* and which projects toward the slit 6. A plurality of the air guide members 4 are aligned at a certain distance, and their base sections (no numerals) are securely inserted or embedded in a solidified plastic 8 which is disposed in a groove (no numeral) of an air guide holder 7. The air guide holder 7 is inserted in a groove (no numeral) of a reed holder 11 together with a lower frame (no numeral) of a reed 2, and secured by means of bolts 12. The reed holder 11 is securely installed on a top section of a slay sword or curved swingable member 10 which is mounted on a rotatable shaft 9 so that the swingable member 10 swings forward and backward (left and right in FIG. 2). The reference numeral 13 denotes a frame of the weaving loom on which the shaft 9 is rotatably supported. A weft inserting nozzle (main nozzle) 14 is provided to pick a weft yarn 15 into the shed S of the warp yarns, under the action of the air jet injected from the weft inserting nozzle 14. The warp yarns forming the shed S are led from a weave front 16 or fel of a woven fabric 17.

Figure 3:
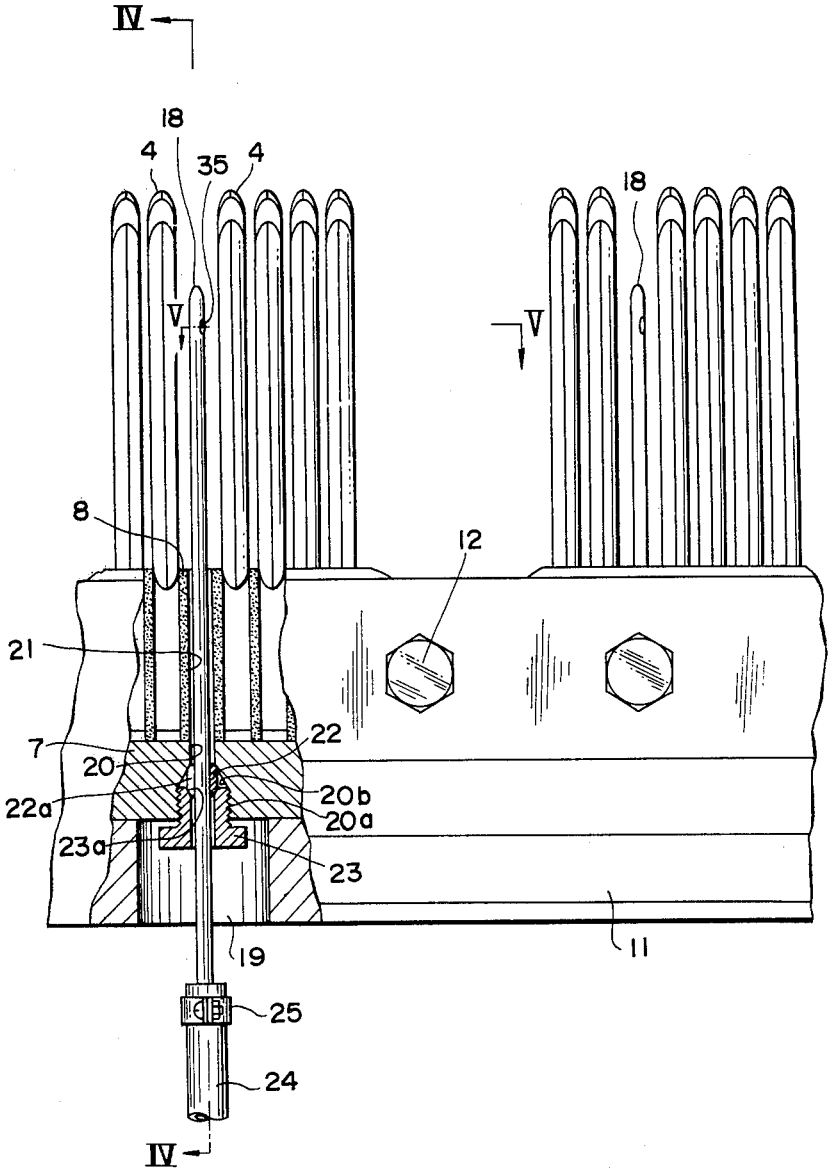
FIG. 3 is an enlarged fragmentary sectional view of the essential part of FIG. 1.
Figure 4:
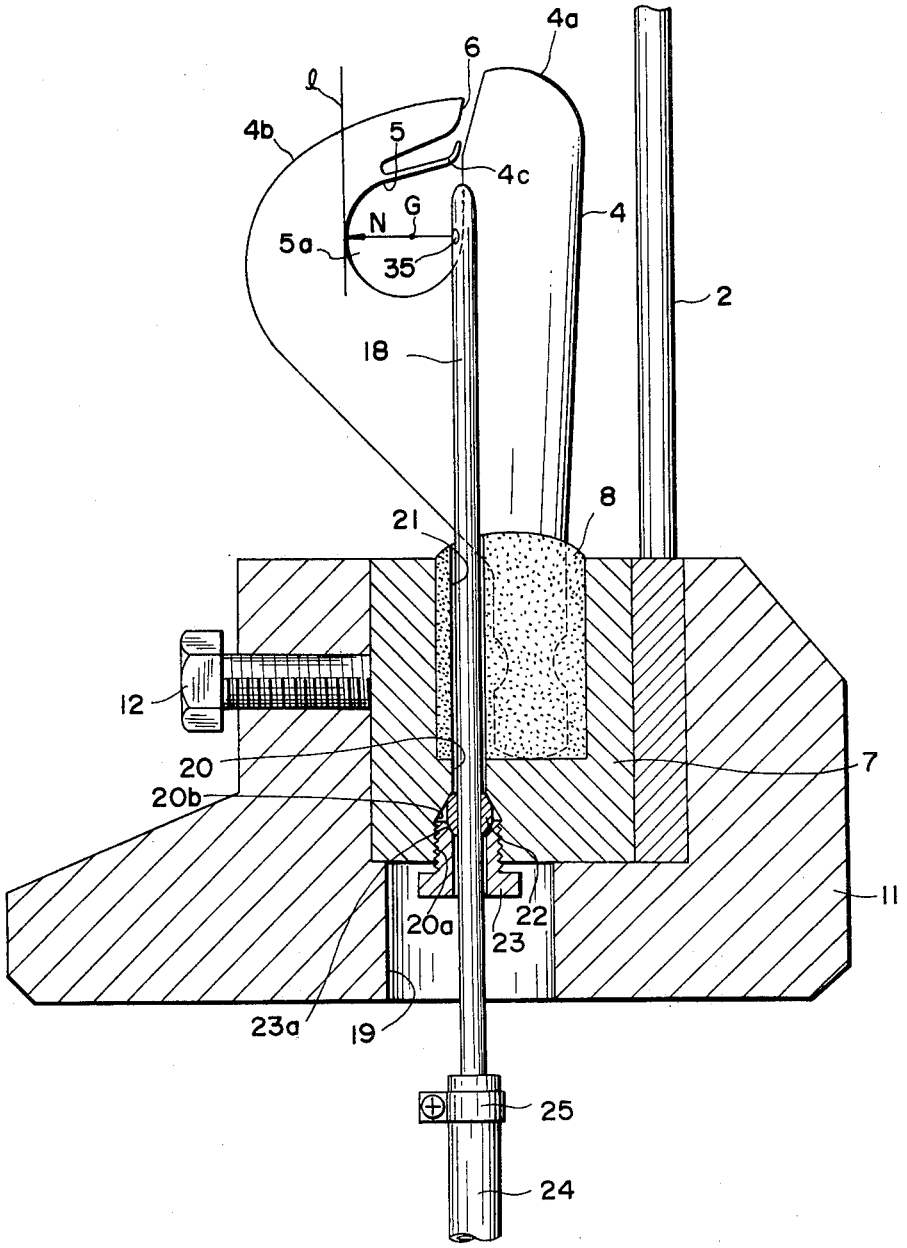
FIG. 4 is a cross-sectional view taken in the direction of the arrows substantially the line IV—IV of FIG. 3.
Figure 5:
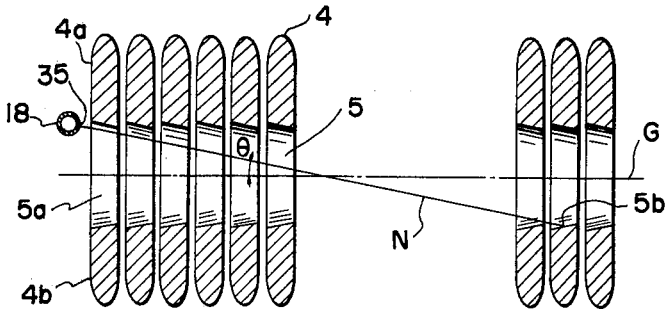
FIG. 5 is a cross-sectional view taken in the direction of the arrows substantially along the line V—V of FIG. 3.

Auxiliary nozzles 18 are provided as shown in FIGS. 3 to 5, in which each auxiliary nozzle 18 is located between two adjacent air guide members 4. The auxiliary nozzle 18 is disposed in a piercing hole which is created by parts 19, 20, and 21 which are respectively formed through the bottom wall of the reed holder 11, the bottom wall of the air guide holder 7, and the plastic 8 filled in the groove of the air guide holder 7. As shown, the top end of the auxiliary nozzle 18 is positioned generally between the adjacent air guide members 4, and more specifically in the vicinity of the air guide opening 5 and between the vertical elongate sections 4*a* of the adjacent air guide members 4. A support member 22 is disposed around the central section of the auxiliary nozzle 18. The support member 22 is formed with a top tapered section which bears against a corresponding tapered section 20*b* formed at the hole 20, and a bottom tapered section which bears against a tapered section 23*a* of a hollow bolt 23 which is disposed around the central section of the auxiliary nozzle 18. The hollow bolt 23 is engaged with a threaded portion 20*a* of the hole 20. Additionally, the support member 22 is formed with a slit 22*a* along the longitudinal axis thereof. Accordingly, the auxiliary nozzle 18 can be securely located at a desired position by screwing the hollow bolt 23 in the hole 20 so that the support member 22 is compressed to decrease its outer diameter by the tapered section 20*b* of the hole and the tapered section 23*a* of the hollow bolt 23. It will be understood that the location of the auxiliary nozzle 18 is selectable by adjusting the hollow bolt 23.

Figure 2:
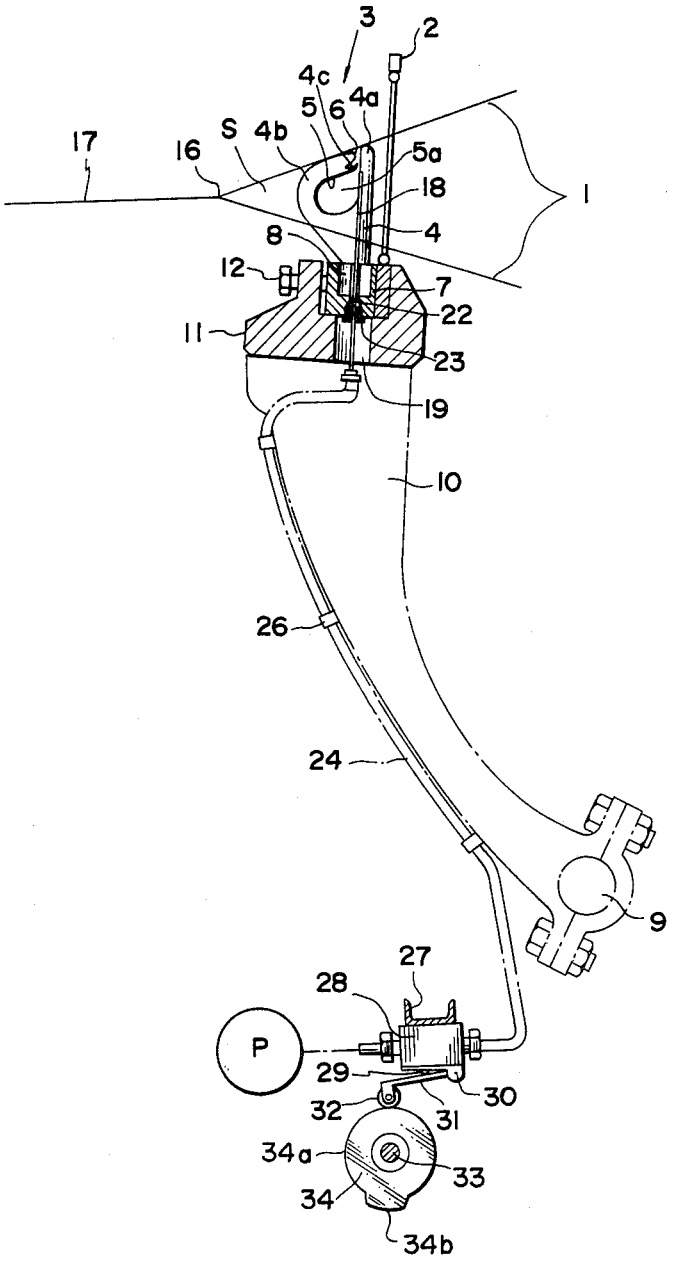
FIG. 2 is a cross-sectional view taken in the direction of the arrows substantially along the line II of FIG. 1.

A flexible pipe 24 is securely connected at its one end to the bottom end section of the auxiliary nozzle 18 by using a fastening band 25. The flexible pipe 24 is, as shown in FIG. 2, fixed at the bottom surface of the reed holder 11 and at the surface of the slay sword 10, and connected at another end to a valve or valve assembly 28 which is arranged to open or close an air passage leading to the pipe 24. The valve 28 is securely installed on a channel member 27 fixed to the frame 13 in the vicinity of the rotatable shaft 9. The valve 28 is in turn fluidly connected to a pressurized air source P. The valve 28 has a movable valve member 29 which is normally biased downward in the drawing to open the valve under the action of a spring (not shown) disposed in the valve. A lever 31 is pivotally connected through by a pin 30 to an outer end section of the valve 28. The lever 31 contacts the valve member 29 to move the valve member 29 upward or downward in the drawing in accordance with the swingable movement thereof. The lever 31 is provided at its free end with a cam follower 32 which contacts the cam face of a cam 34 which is securely mounted on a rotatable axis 33. The rotatable axis 33 is arranged to rotate one time per an operational rotation of the loom or a reciprocal motion of the reed 2. The cam 34 is formed with a low section 34*a* and a high section 34*b*. Accordingly, the valve 28 is normally closed when the cam follower 32 contacts the low section 34*a* of the cam face, whereas the valve 28 is opened when the cam follower 32 contacts the high section 34*b* of the cam face so that the valve member 29 is pushed up in the drawing by the lever 31. It is to be noted that the high section 34*b* of the cam face is formed so as to contact the cam follower 32 from a time immediately before the leading end of the picked weft yarn 15 reaches the vicinity of the auxiliary nozzle, until a time point at which the weft picking is completed or finished.

Figure 6:
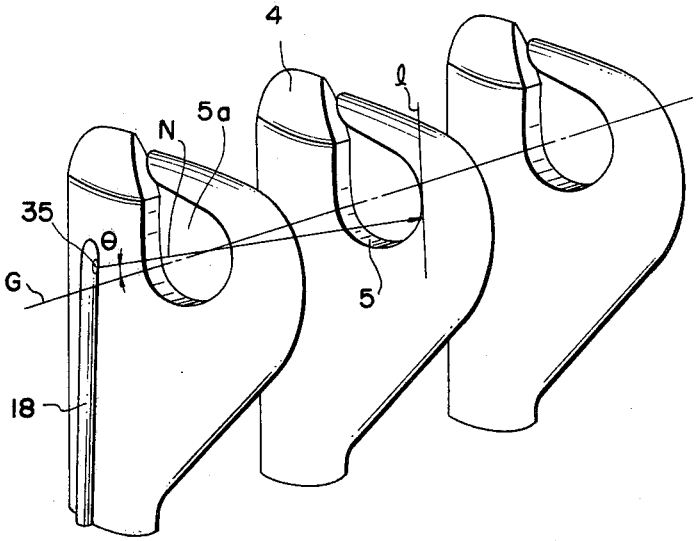
FIG. 6 is a perspective view showing the relationship between an auxiliary nozzle and air guide members used in the weft picking device of FIG. 1.

The auxiliary nozzle 18 is closed at its top end which is formed into the shape of a cone whose top is rounded, and formed at its cylindrical side wall section with a small radial cylindrical nozzle opening 35. As shown in FIGS. 4, 5, and 6, the nozzle opening 35 is located at the same height as the axis G of the air guide channel 5*a* formed through air guide openings 5 of the air guide members 4, relative to the upper surface of the reed holder 11. The radial nozzle opening 35 is so formed that the extension N of its axis (shown in FIGS. 5 and 6) or an air ejection direction line along which air is injected, in this case, intersects the axis G at an angle $\theta$ on a plane containing the axis of the nozzle opening 35 and the axis G of the air guide channel 5*a*. The extension N of the axis, after intersecting with the axis G, is directed to a point 5*b* on a tapered surface of the air guide member 4 which is located farther from the weft inserting nozzle 14, than the auxiliary nozzle 18, the tapered surface defining the air guide opening 5 as seen from FIG. 5. Accordingly, a tangent line of the air guide opening at the point 5*b* is perpendicular to the above-mentioned plane containing the axis of the nozzle opening 35 and the axis G of the air guide channel. It is to be noted that the axis G of the air guide channel is capable of being aligned or of coinciding with the axis of the weft inserting nozzle 14.

The manner of operation of the above-mentioned weft picking device will be explained hereinafter.

When the reed 2 moves backward, each air guide member 4 of the air guiding device 3 which moves with the reed 2 enters the shed S of the warp yarns pushing aside the warp yarns 1. Consequently, the auxiliary nozzle 18 also enters the shed of the warp yarns pushing aside the warp yarns 1. Then, the location of the air guide opening 5 of the air guide member 4 coincides with the main nozzle 14 in the vicinity of the mostbackward location of the reed 2. At this moment, the main nozzle 14 ejects an air jet along the axis G of the air guide channel 5*a*, so that the air jet is guided by the air guide channel 5*a* so as to prevent the air jet from spreading. The weft yarn 15 is picked by the action of the thus formed air jet. Immediately before the leading end of the picked weft yarn 15 reaches the vicinity of the auxiliary nozzle 18, the high section 34*b* of the cam 34 contacts the cam follower 32 to push up or withdraw the valve member 29 by contact with the lever 31 so as to open the valve 28. As a result, pressurized air is supplied through the pipe 24 to the auxiliary nozzle 18, and is ejected from the nozzle opening 35 of the auxiliary nozzle 18. This air jet from the auxiliary nozzle 18 compensates and assists the air jet from the main nozzle 14 to achieve weft picking operation.

When the weft picking is completed, the ejection of air from the main nozzle 14 is also finished, and the cam follower 32 attached to the lever 31 contacts the lower section 34*a* of the cam face of the cam 34, so that the valve member 29 is pushed out by the action of the spring disposed in the valve 28. As a result, the valve 28 is closed, and the ejection of air from the nozzle opening of the auxiliary nozzle 18 is stopped.

With the subsequent forward movement of the reed 2, the air guide members 4 and auxiliary nozzles 18 move out of the shed S of the warp yarns. During removal of the air guide members 4 and the auxiliary nozzles 18, the picked weft yarn 15 is supported or pushed by the lower side warp yarn 1 forming the shed S so as to move out of the air guide opening 5 through the slit 6. Then, the picked weft yarn 15 is beat up against the weave front 16 by the reed 2 to form a woven fabric 17.

While the auxiliary nozzle 18 is so located as to be parallel with the axis (not identified) of the vertical elongate section 4*a* of the air guide member 4 in the above-mentioned embodiment, it will be understood that it may be so located that the axis thereof crosses the axis of the elongate section 4*a* of the air guide member as viewed from the direction of the main nozzle 14.

Now, the operation and function of the weft picking device according to the present invention will be explained in detail with reference to FIGS. 7 and 8.

Figure 7:
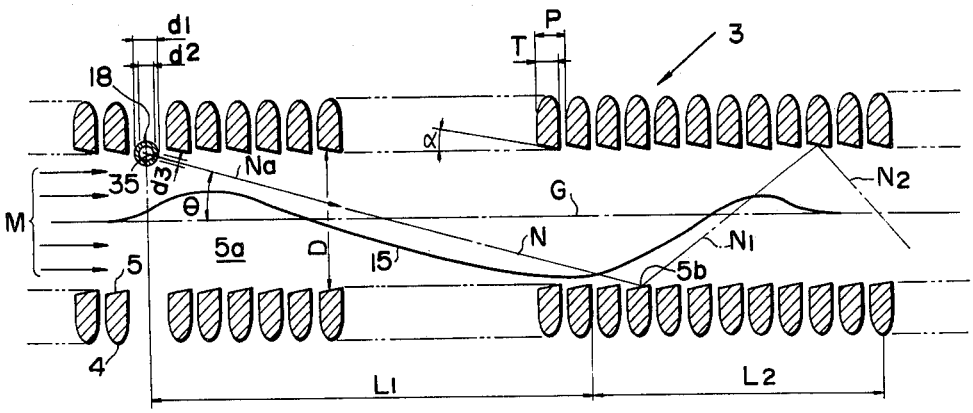
FIG. 7 is a schematic illustration explaining the operation and effect of the device of FIG. 1.

In FIG. 7, the air ejection direction line N from the nozzle opening 35 of the auxiliary nozzle 18 extends on the above-mentioned surface (referred hereinafter to as a surface N—G) containing the air ejection direction line N and the axis G of the air guide channel 5*a*, and strikes against the above-mentioned point 5*b*. Since the tangent line l at the point 5*b* is perpendicular to the plane N—G, the air ejection direction line N changes to a reflecting line $N_1$ at the point 5*b*, which line $N_1$ reaches the surface of the air guide opening of an obliquely opposite air guide member as illustrated, so that a further reflecting line $N_2$ is generated here. As a result, a zigzag reflecting line is theoretically formed on the surface N—G. Additionally, since the air guide opening 5 of the air guide member 4 is tapered in cross-section with an angle of $\alpha$ relative to the axis G as mentioned above, the pitch of the zigzag reflecting line gradually decreases. Now, assuming that the intensity of the high speed air jet Na does not decrease, the air jet advances along the above-mentioned zigzag reflecting line. This is carried out on the surface N—G and accordingly does not cause tubulence such as does rotation of main air stream M from the main nozzle 14.

Now, turning to the actual phenomena observed during a fundamental experiment showing the effect of the present invention, a picked weft yarn denoted by the reference numeral 15 is schematically shown in FIG. 7. The yarn shape was obtained by observing the actual figure of the picked weft yarn through apertures among the air guide members 4 and sketching it. This figure of the picked weft yarn corresponds to a figure of a picked weft yarn advancing on a stream line along the axis G of the air guide channel 5*a*.

The fundamental experiment was conducted by securely mounting an air guide device 3 on a test stand (not shown), and by supplying the main air stream M from one side of the air guide device 3. The conditions of the test was as follows:

prepared weft yarn: English Cotton Count No. 40 single spun yarn (cotton 100%) one end (left in the drawing) being fixed.

--- air guide member:
- thickness T = 2.9 mm
- pitch P = 3.7 mm
- guide opening average diameter D = 18 mm
- taper angle $\alpha$ = 7° flow rate of the main air stream 30 m/sec.

auxiliary nozzle:
- outer diameter $d_1$ = 3.0 mm
- inner diameter $d_2$ = 2.0 mm
- diameter of nozzle opening $d_3$ = 1.0 mm
- intersecting angle $\theta$ = 15°
- ejection speed = the speed of sound [the speed of sound was set by maintaining the air pressure above the critical pressure (3 kg/cm$^2$)]

---

This experiment exhibited the following facts: the picked weft yarn 15 was initially inclined toward the air ejection direction line N and then directed in the direction of the line N. Thereafter, the weft yarn 15 was turned at a point in front of the point 5*b* and extended in the direction of the reflecting line $N_1$. The weft yarn 15 extended to a point beyond the axis G and then returned in the direction of the reflecting line $N_2$ so that the figure of the picked weft yarn resembled a wave form which rapidly decreased in height and in pitch of the waves so as to converge into the axis G. After convergence, the weft yarn 15 extended on the axis G. As clearly shown in FIG. 7, the distance $L_1$ from the nozzle opening 35 to the first turning point was 60 mm; the distance $L_2$ from the first turning point to a converging point is 40 mm; and the flow rate in the vicinity of the converging point is about 40 m/sec.

The above-mentioned phenomena will be considered hereinafter. The air stream Na of the speed of sound at first advances on the air ejection direction line N, pulling the air streams near the air stream Na to direct them approximately in the direction of the line N. This decreases the energy of speed of the air stream Na from the auxiliary nozzle 18, causing the air stream line Na to gradually spread. With respect to an air stream bundle including the air stream Na and the main air stream M which is pulled and accelerated, the outer air stream lines are turned when they reach the inner surface of the air guide channel 5*a*, by which the inner air stream lines are urged in the direction of the axis G so as to be turned in the direction of the axis G. As a result, the air stream bundle as a whole is turned at a location in front of the point 5*b*. Such phenomena are the same in the subsequent returning of the air stream bundle. The converging of the weft yarn 15 into the axis G immediately after the above-mentioned return phenomena shows the fact that a stable air stream along the axis G is reproduced for the same reason that the air stream line bundle as a whole receives much converging effect as compared with turning effect by the inner surface of the air guide channel. This results from the fact that, during the process of returning to converging of the weft yarn 15, the relative speed of the auxiliary air stream Na and the accompanying main air stream M becomes sufficiently low in addition to the fact that the density of the air stream lines becomes low.

Now, the taper angle $\alpha$ of the actual air guide member which was prepared by the inventors is within a range from 7° to 12°. As a result of experiments on the air guiding device using such air guide members, it was confirmed that the intersecting device angle $\theta$ between the air ejection direction line N of the auxiliary nozzle 18 and the axis G of the air guide channel 5*a* is preferably within a range from 10° to 20°. With respect to this range, if the intersecting angle $\theta$ is smaller than 10°, the converging point becomes too far from the auxiliary nozzle 18 in case that the taper angle $\alpha$ is relatively small, and the air stream ejected from the nozzle opening 35 is disturbed by the absorption effect of inner surface of the air guide opening adjacent to the nozzle opening 35 in case that the taper angle $\alpha$ is relatively large. If the intersecting angle 0 is larger than 20°, the pitch at which the air stream line bundle becomes too small thereby causing turbulence of the ejected air stream. This fact was confirmed from the movement of the weft yarn 15. It is to be noted that good results could be obtained in any cases, when the intersecting angle $\theta$ was set at an angle of 15°.

Figure 8:
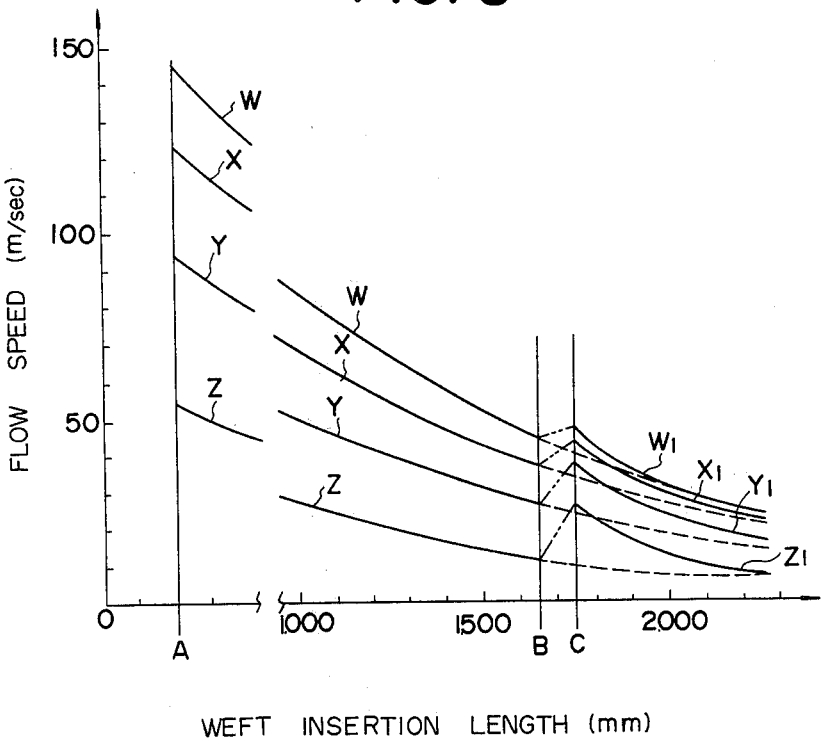
FIG. 8 is a graph explaining the operation and effect of the device of FIG. 1.
Figure 9:
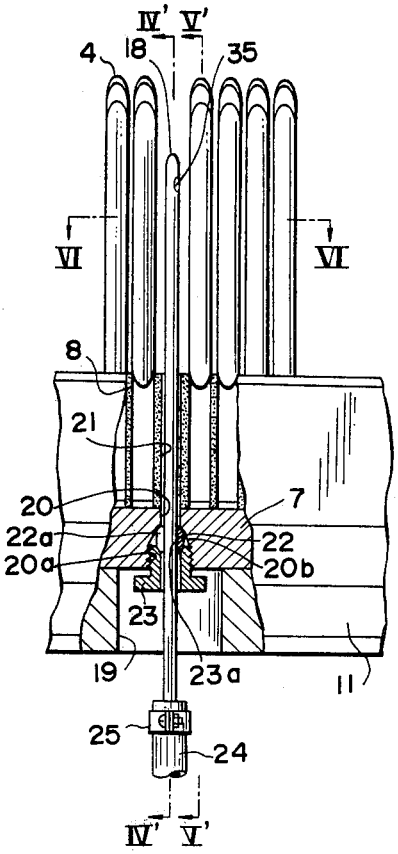
FIG. 9 is an enlarged fragmentary sectional view similar to FIG. 3, but showing an essential part of a second embodiment of the weft picking device according to the present invention.
Figure 10:
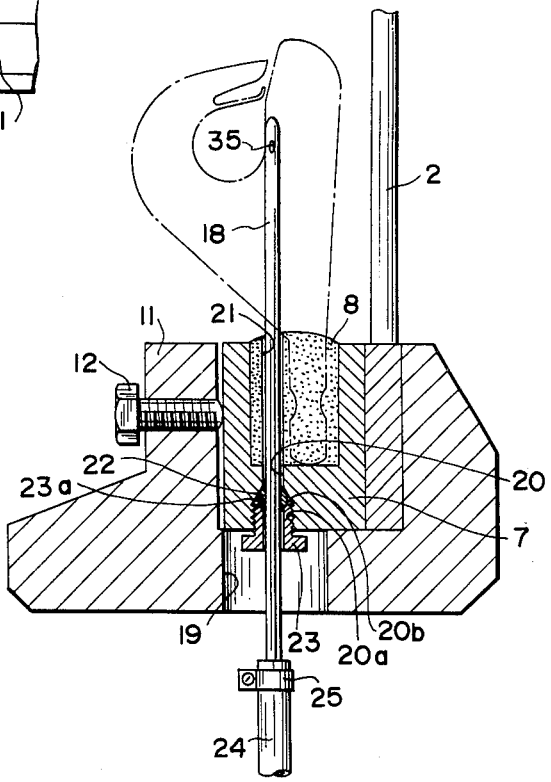
FIG. 10 is a cross-sectional view taken in the direction of the arrows substantially along the line IV'—IV' of FIG. 9.
Figure 11:
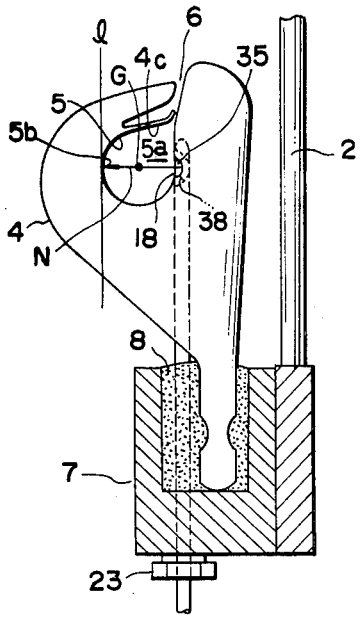
FIG. 11 is a cross-sectional view taken in the direction of arrows substantially along the line V'—V' of FIG. 9.

FIG. 8 shows a result which was obtained by experiments conducted on an air guiding device used in a loom for weaving wide fabric. In the graph of FIG. 8, an abscissa represents a weft picking length or the distance from the nozzle opening of the main nozzle, and an ordinate represents a flow speed of the main air stream M (in FIG. 7) which flow speed was measured by a Pitot tube. The air guiding device used in this experiment was same as in that in FIG. 7 with the exception that the average diameter D of the air guide opening was changed to 14 mm, so that the condition of the auxiliary nozzle is the same as in that in FIG. 7. This experiment was conducted by changing the air pressure supplied to the main nozzle 14. In the graph of FIG. 8, a point A (weft insertion length: 200 mm) indicates a location at which normally the main air stream from the main nozzle 14 completes its drawing action to the weft yarn and enters its carrying step for the weft yarn. A point B (weft insertion length: 1650 mm) indicates a location in the vicinity of a location beyond the width of a normal fabric. It is to be noted that an auxiliary nozzle was located at the point B. A point C indicates a location at which the water head of the Pitot tube becomes stable, and accordingly the point C corresponds to the above-mentioned converging point of the weft yarn. Additionally, the curves $W—W_1$, $X—X_1$, $Y—Y_1$, and $Z—Z_1$ indicate flow speeds at the air pressures 4, 3, 2, and 1 $Kg/cm^2$, respectively. It is to be noted that accurate measurements were difficult at a range between the points B and C, and therefore the curves are connected with broken lines in FIG. 8. According to this experiment, it became apparent that the distance from the auxiliary nozzle 18 to the above-mentioned converging point is constant regardless of variation of the flow speed of the main air stream M from the main nozzle 14, in which the value of the distance was approximately 100 mm ($L_1+L_2$) the same as in the experiment of FIG. 7. It was also shown that the assistance effect of the auxiliary air stream to the main air stream becomes noticeable as the flow speed of the main air stream is low. Hence, the auxiliary nozzle 18 according to the present invention can exhibit a sufficient effect if it is located far from the main nozzle 14. Additionally, if the auxiliary nozzles are disposed at a plurality of locations so as to form a mode in which the curve $Z_1$ is connected to the extension of the curve $Y—Y_1$ through the above-mentioned broken line, it is apparent that the weft insertion length can be greatly increased by using a quite small number of the auxiliary nozzles. Remembering that the first conventional device mentioned in the introductory part of the present specification requires a large number of auxiliary nozzles, it will be understood that the present invention is advantageous from a standpoint of pressurized air economy.

Apparent from the foregoing, according to the present invention, in the weft picking device provided with an air guide channel for carrying a weft yarn which channel is constructed by an aligned air guide members, an auxiliary air stream is ejected from a single opening of an auxiliary nozzle, by which a zigzag theoretical reflecting line whose pitch is gradually decreased is set by using the tapered surface of the air guide opening of each air guide member.

The thus set zigzag reflecting line guides and assists the main air stream from the main nozzle, and therefore the main air stream can be returned to a normal condition without harmful turbulence flow if the advancing direction of the main air stream is once disturbed. Hence, a weft yarn injected from the main nozzle is prevented from vibrating particularly at its leading end, so that weft picking is effectively achieved along a desirable course. Such weft picking can be accomplished by a quite small number of the auxiliary nozzles, providing a weaving loom which is low in operation cost.

Referring to FIGS. 9 to 13, a second embodiment of the weft picking device according to the present invention will be illustrated, which is similar to the first embodiment shown in FIGS. 1 to 8 and accordingly the same reference numerals as in the first embodiment designate the same parts and elements. It is to be noted that, in this embodiment, the auxiliary nozzle 18 is located far from the axis G of the air guide channel so that the auxiliary nozzle 18 does not project into the air guide channel 5*a* as viewed from the direction of the weft inserting nozzle 14 (not shown) as clearly shown in FIG. 10. The auxiliary nozzle 18 is formed with a small radial cylindrical nozzle opening 35. The nozzle opening 35 is so located that the extension N of the axis of the nozzle opening 35 intersects the axis of the air guide channel 5*a* at an angle $\theta$, for example 15 degrees, on the plane containing the axis G of the air guide channel and the axis of the nozzle opening 35. The extension N of the nozzle opening 35 is then directed to the point 5*b* on the surface of the air guide opening 5 of an air guide member 4 which is located further than the auxiliary nozzle 18 relative to the weft inserting nozzle 14 as seen from FIG. 12. Additionally, the tangent line l of the air guide opening 5 at the point 5*b* is perpendicular to the above-mentioned plane containing the axes of the air guide channel and the nozzle opening 35 of the auxiliary nozzle 18.

Figure 13:
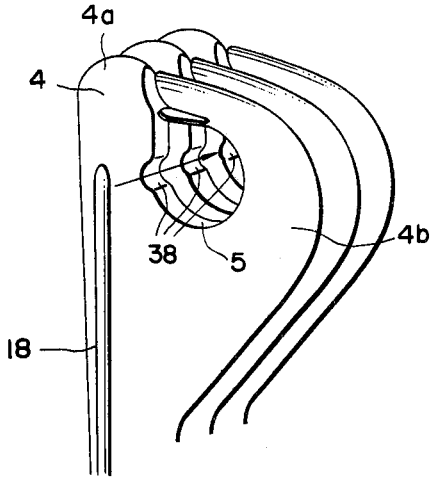
FIG. 13 is a perspective view showing the relationship between an auxiliary nozzle and air guide members used in the device of FIG. 9.
Figure 12:
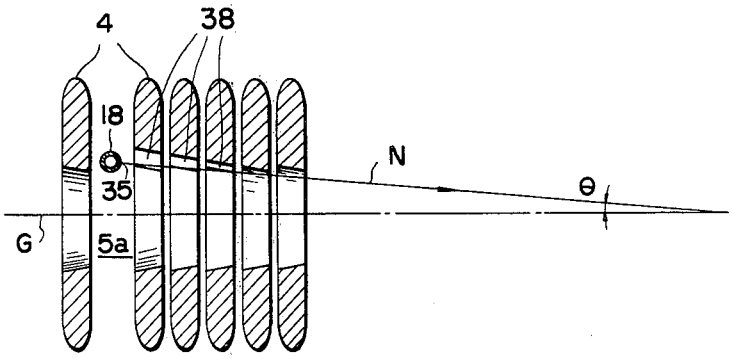
FIG. 12 is a cross-sectional view taken in the direction of arrows substantially along the line VI—VI of FIG. 9.

As shown in FIGS. 12 and 13, cutout portions or grooves 38 are formed at the elongate sections 4a of several air guide members, respectively, which are located farther than the auxiliary nozzle relative to the weft inserting nozzle 14. Each cutout portion 38 is tapered in the direction of weft insertion along the air guide channel 5a. The several cutout portions 38 become smaller relative to their distance from the auxiliary nozzle 18. These cutout portions 38 are formed along the extension N of the axis of the nozzle opening 35 of the auxiliary nozzle 18 and serve as a guide way for the air stream ejected from the nozzle opening 35.

The manner of operation of the weft picking device shown in FIGS. 9 to 13 is as follows:

Air ejected from the nozzle opening 35 of the auxiliary nozzle 18 flows along the direction of the extension N of the nozzle opening axis, passing through the grooves 38 formed on the inner surface of the air guide member 4. The ejected air stream attracts thereto the surrounding air streams to guide them along the direction of the extension N, and further accelerates the speed of the surrounding air streams. The ejected air stream then strikes against the point 5b on the surface of the air guide opening 5 to reflect toward the other point on the opposite surface of the air guide opening, so that the ejected air stream advances in zigzag pattern in the vicinity of the nozzle opening 35 of the auxiliary nozzle 18. The pitch of the zigzag pattern gradually decreases since each of the air guide openings 5 of the air guide member 4 is tapered as mentioned above. This process is carried out on the plane containing the axes of the air guide channel 5a and the nozzle opening 35, and accordingly the main air stream from the main nozzle 14 as a whole never causes turbulence such as rotation thereof. Accordingly, the intensity decrease in the main air stream from the main nozzle 14 can be effectively compensated for by the auxiliary air stream from the auxiliary nozzle 18. It will be appreciated that the auxiliary nozzle 18 is disposed substantially outside of the air guide channel 5a and therefore the picked weft yarn is never caught by the auxiliary nozzle 18.

As will be understood from the foregoing, according to the embodiment shown in FIGS. 9 to 13, the auxiliary nozzle is disposed substantially outside of the air guide channel, so that the air jet from the auxiliary nozzle is ejected along a desired direction passing through the grooves formed at the several air guide chambers located farther than the auxiliary nozzle relative to the weft inserting nozzle. This prevents the picked weft yarn from being caught by the auxiliary nozzle without reduction in the intensity of the air ejected from the auxiliary nozzle.

Referring to FIGS. 14 to 25, a third embodiment of the weft picking device according to the present invention will be illustrated, which is similar to the first embodiment of FIGS. 1 to 6 except for the presence of a boat-like member 36, and accordingly the same reference numerals as in the first embodiment denote the same parts and elements.

Figure 14:
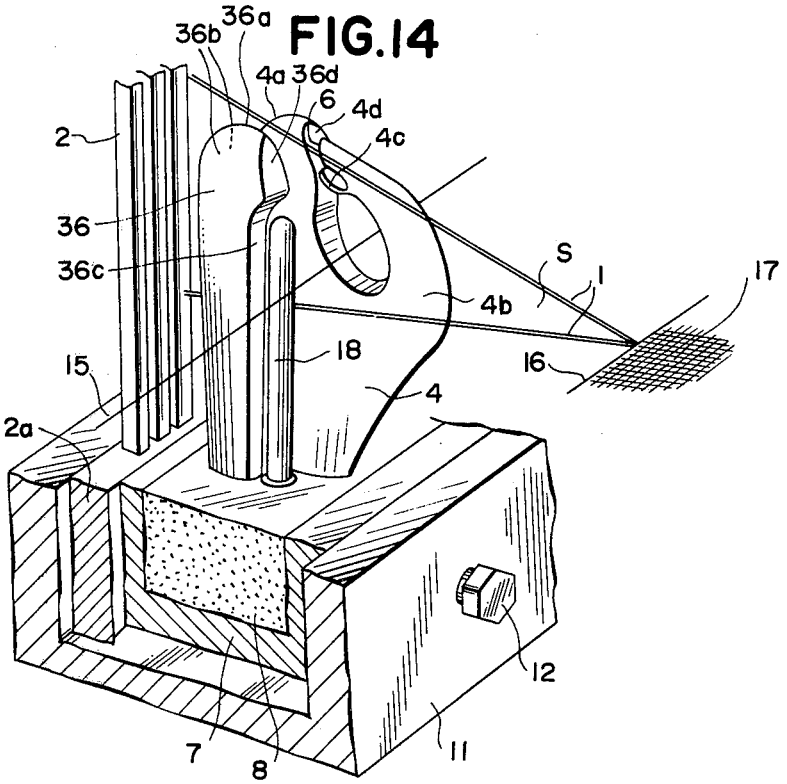
FIG. 14 is a perspective view showing an essential part of a third embodiment of the weft picking device according to the present invention.
Figure 15:
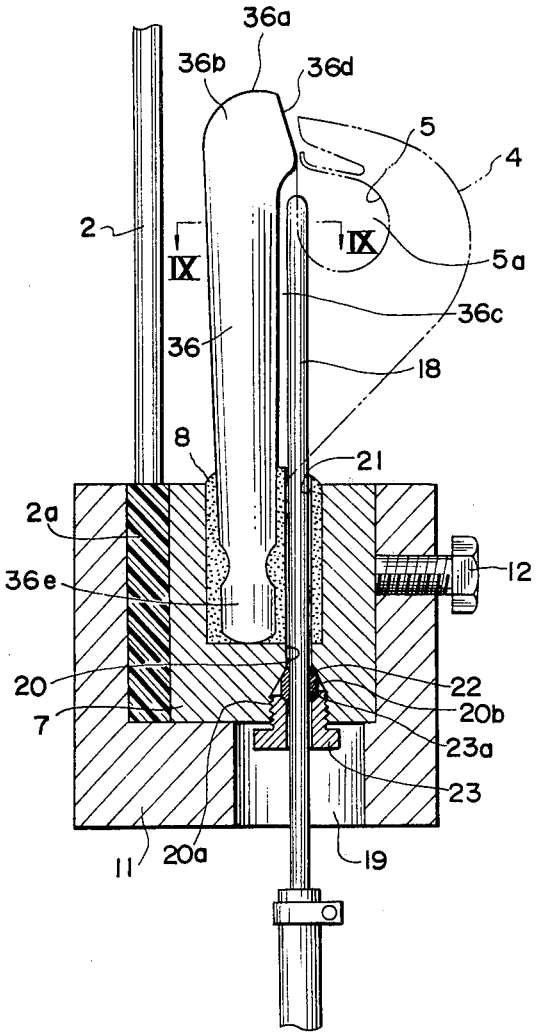
FIG. 15 is a vertical cross-sectional view of the essential part of FIG. 14.

As shown in FIGS. 14 to 18, the boat-like member 36 is provided to push aside the warp yarns 1 when the auxiliary nozzle 18 enters the shed S of the warp yarns. The boat-like member 36 is securely embedded at its one end or bottom end in the solidified plastic 8. The boat-like member 36 is located between the adjacent two air guide members 4 and further between the auxiliary nozzle 18 and the dents (no numeral) of the reed 2 which dents are securely supported by a frame 2a of the reed. As shown in FIG. 14, the top section of the boat-like member 36 is formed with generally symmetrical smooth surfaces 36b which extend downward from a ridge 36a of the boat-like member. The ridge 36a continues along a side, facing the dents of the reed 2, of the boat-like member and extends into the plastic 8. As seen, the smooth surfaces 36b also extend to the surface of the plastic 8. A side, facing the auxiliary nozzle 18, of the boat-like member 36 is formed into a flat surface 36c which has, for example, a width of 3 mm. The flat surface 36c is so located be to slightly nearer than the periphery of the guide opening 5 relative to the dents of the reed 2, as viewed from the direction of the weft inserting nozzle 14 (not shown). The boat-like member 36 is further formed with another flat surface 36d which connects the ridge 36a with the above-mentioned flat surface 36c. The flat surface 36d is the same shape as a surface 4d, defining the slit 6, of the vertical elongate section 4a of the air guide member 4, and accordingly the profiles of the surfaces 36d and 4d generally coincide as viewed from the direction of the weft inserting nozzle 14. It will be understood that the boat-like member 36 is formed into a shape similar to that of the vertical elongate section 4a of the air guide member 4. As clearly shown in FIG. 18, the boat-like member 36 is so located that the top-most portion thereof lies at the same level as that of the vertically elongate section 4a of the air guide member 4.

Figure 16:
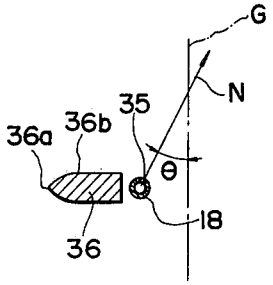
FIG. 16 is a cross-sectional view taken in the direction of arrows substantially along the line IX—IX of FIG. 15.
Figure 17:
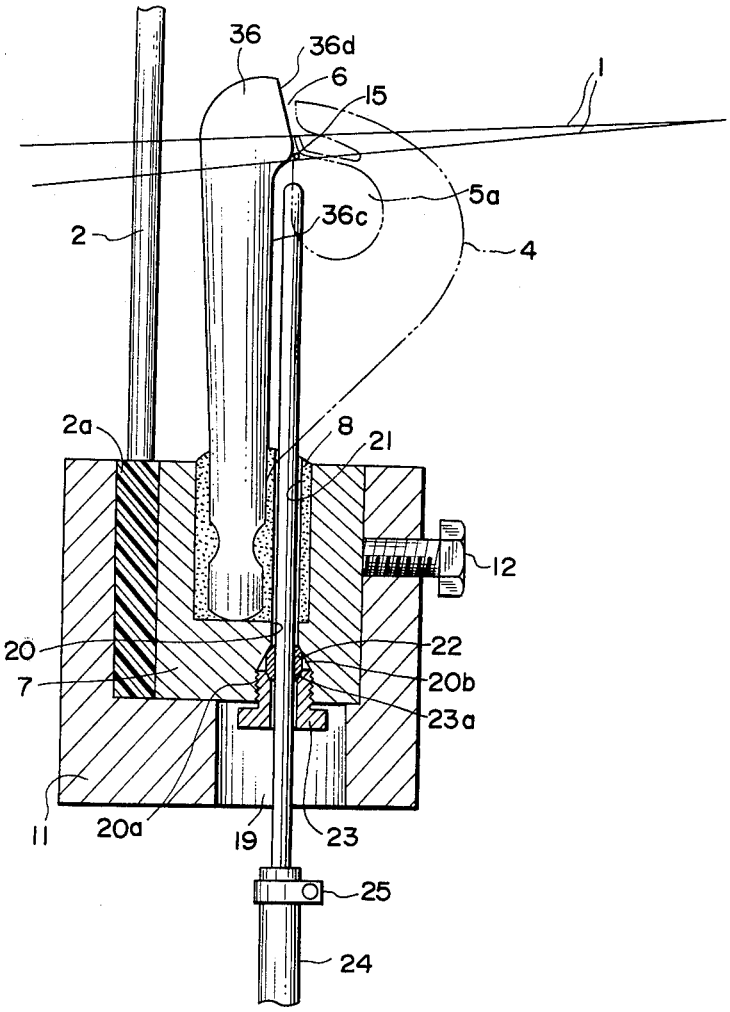
FIG. 17 is a vertical cross-sectional view illustrating the operation of the device of FIG. 14.
Figure 18:
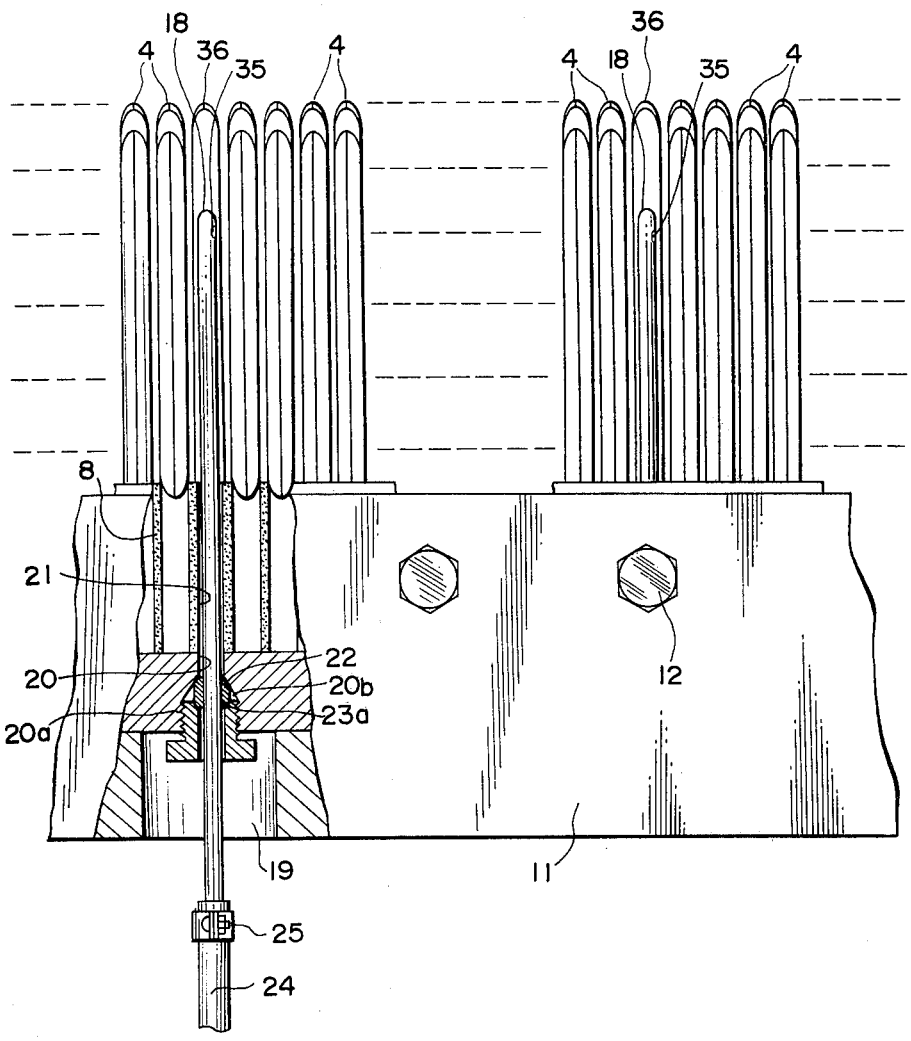
FIG. 18 is a front view of the essential part of FIG. 15.

It will be noted that, also in this third embodiment of the present invention, the auxiliary nozzle 18 is provided with a small cylindrical nozzle opening 35 which is so located that the extension N of the axis thereof intersects the axis G of the air guide channel 5a at a predetermined angle $\theta$ on the plane containing the axis of the nozzle opening 35 and the axis G of the air guide channel as shown in FIG. 16.

The manner of operation of the weft picking device of this third embodiment of the present invention will now be explained.

As illustrated in FIG. 14, when the air guide members 4 and the boat-like members 36 advance, pushing aside the warp yarns, into the shed of the warp yarns 1 so that the axis G of the air guide channel 5 coincides with the axis of the weft inserting nozzle 14 (not shown), an air jet is ejected from the weft inserting nozzle to achieve weft picking under the action of the air jet. Immediately before the leading end of the picked weft yarn 15 reaches the vicinity of the auxiliary nozzle 18, pressurized air is supplied to the auxiliary nozzle 18 so that an air jet is ejected from the nozzle opening 35 of the auxiliary nozzle 18 along the axis of the air guide channel 5a until weft picking is completed, in which the air jet from the auxiliary nozzle is directed to angularly intersect the axis G of the air guide channel 5a as shown in FIG. 16. As a result, the weft picking is securely achieved with the assistance of the auxiliary nozzle 18.

It is to be noted that, according to the third embodiment of the present invention, the boat-like member 36 used for pushing aside the warp yarns is formed separate and independent from the auxiliary nozzle 18, and therefore the locations and directions of both the boat-like member and the auxiliary nozzle are freely and suitably selectable.

Accordingly, the boat-like member 36 can ideally push aside the warp yarns, since the boat-like member is suitably fixed relative to the reed holder 11 and thereafter it is not necessary to move the boat-like member. Additionally, the auxiliary nozzle 18 becomes movable in its axial direction and rotatable about its axis by loosening the nut 23 shown in FIG. 15, so that the location and the direction of the nozzle opening 35 of the auxiliary nozzle 18 is freely adjustable. Furthermore, the auxiliary nozzle 18 can be securely fixed relative to the reed holder 11 by tightening the nut 23.

The auxiliary nozzle 18 moves in the array of the warp yarns which are pushed aside under the action of the boat-like member 36, and it will be understood that the top-most portion of the auxiliary nozzle 18 never functions to push aside the warp yarns.

Even when the weft yarn 15 lies in the vicinity of a section of the boat-like member 36 connecting the flat surfaces 36*c*, 36*d* during the weft picking, the weft yarn 15 can be smoothly beat up by the reed after passing through the slit 6 without being caught by the the connecting section, since the connecting section is formed smoothly curved so as not to function as a hook. Besides, the picked weft yarn 15 is never caught by the above-mentioned connecting section of the boat-like member 36 even when the auxiliary nozzle 18 and the boat-like member 36 move out of the array of the warp yarns in rubbing contact with the warp yarns.

As shown in FIGS. 14 to 17, the auxiliary nozzle 18 may be slightly projected into the air guide channel 5*a* as viewed from the direction of the weft inserting nozzle. In this regard, one might fear that the weft yarn 15 will be caught by the auxiliary nozzle 18 if the auxiliary nozzle is excessively projected into the air guide channel 5*a*. Therefore, the permissible projection amount of the auxiliary nozzle 18 into the air guide channel 5*a* is a dimension of about half of the diameter of the auxiliary nozzle.

If the diameter of the auxiliary nozzle 18 is smaller than the thickness of the boat-like member 36, it is not necessary that the head section of the auxiliary nozzle 18 be formed smooth. On the contrary, if the diameter of the auxiliary nozzle 18 is larger than the thickness of the boat-like member 36, it is preferable that the head section of the auxiliary nozzle 18 is formed into the shape of a cone of hemisphere. Besides, the shape in cross-section of the head section of the auxiliary nozzle may be rectangular or hexagonal in addition to circular as shown in the embodiments. In such cases, it is preferable that the corners or edges are rounded.

Figure 19:
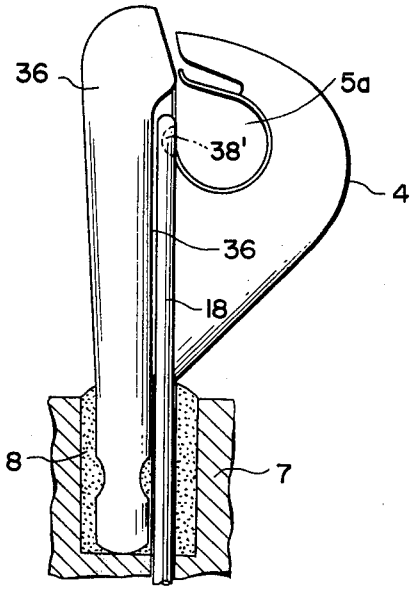
FIG. 19 is a sectional view showing the essential part of a modified example of the third embodiment of FIG. 14.
Figure 20:
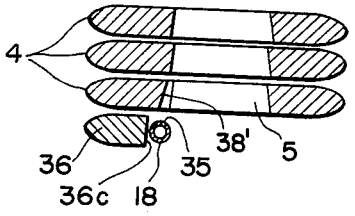
FIG. 20 is a horizontal sectional view of the essential part of FIG. 19.
Figure 21:
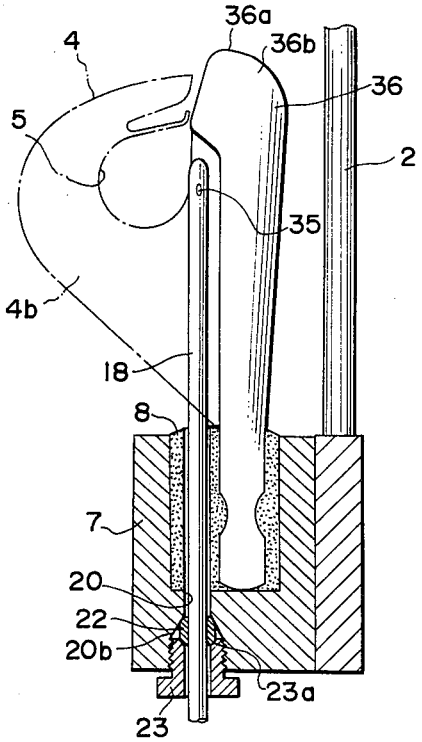
FIG. 21 is a sectional view showing the device of FIG. 19, but taken from the direction opposite to the view of FIG. 19.

FIGS. 19, 20 and 21 show a modified example of the third embodiment of the present invention, in which the auxiliary nozzle 18 is not projected into the air guide channel 5*a*. In this example, the flat surface 36*c* of the boat-like member 36 is withdrawn toward the reed 2 so that the auxiliary nozzle comes near the reed 2. Additionally, a semicircular cutout portion or guide groove 38' is formed at the inner periphery of the air guide opening 5 of the air guide member 4 which is located adjacent the nozzle opening 35 of the auxiliary nozzle 18, by which the air jet ejected from the auxiliary nozzle is not interrupted by the air guide member.

Figure 22:
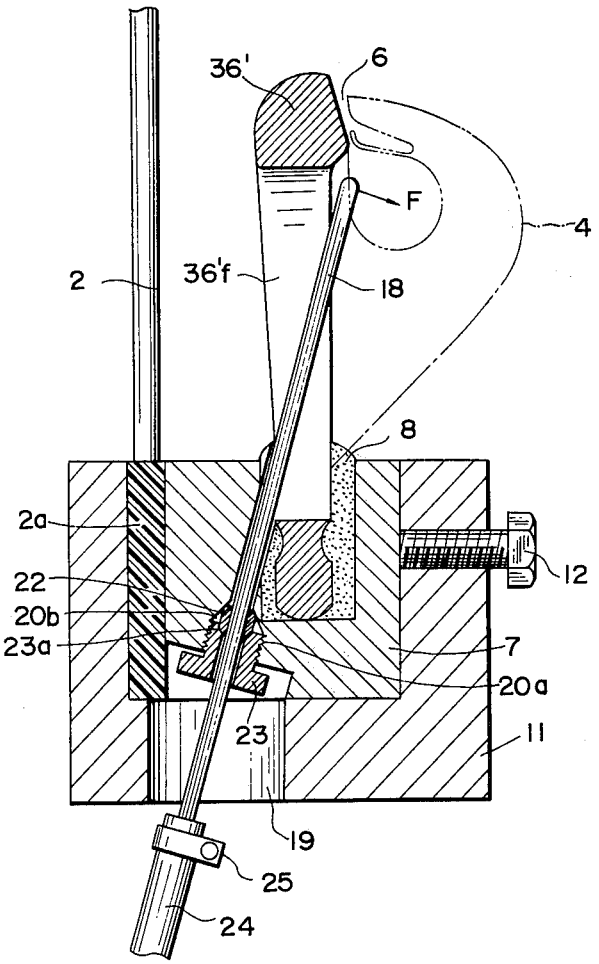
FIG. 22 is a sectional view showing the essential part of another modified example of the third embodiment of FIG. 14.
Figure 23:
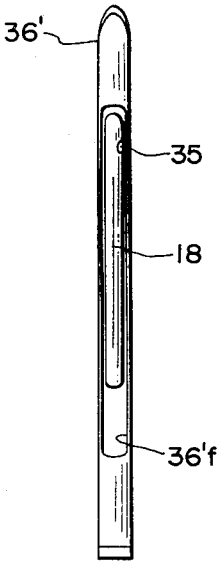
FIG. 23 is a front view of the essential part of the device of FIG. 22.

FIGS. 22 and 23 show another modified example of the third embodiment of the present invention, in which the boat-like member 36' is made of a metal such as aluminum, and is formed with a hollow 36'f. The auxiliary nozzle 18 is disposed in the hollow 36'f so as to angularly pass through the hollow. In other words, the axis of the auxiliary nozzle 18 intersects the axis (not shown) of the boat-like member 36' as viewed from the direction of the weft inserting nozzle (not shown). In this case, the air from the auxiliary nozzle 18 is ejected in the direction of an arrow generating a component which becomes far from the slit 6, and therefore the center of the air stream from the auxiliary nozzle lies far from the slit 6. This decreases opportunities in which the weft yarn 15 moves out of the air guide channel 5*a* through the slit 6.

Figure 24:
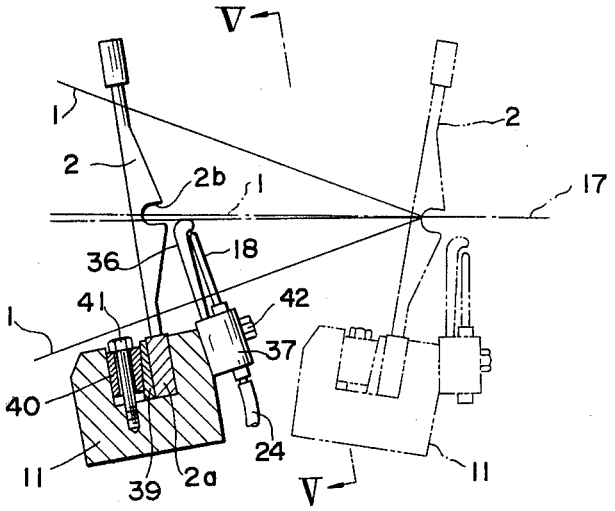
FIG. 24 is a schematic illustration showing the essential part of a further modified example of FIG. 14.
Figure 25:
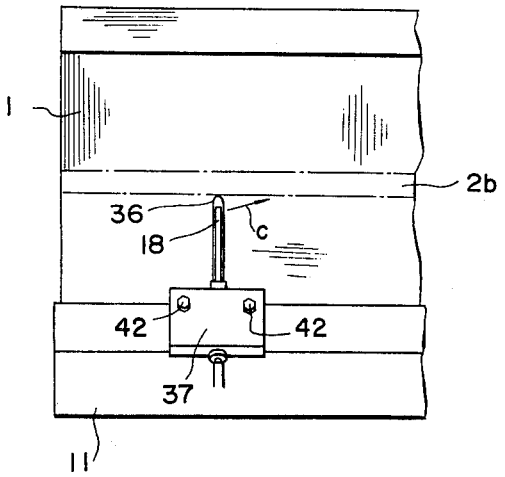
FIG. 25 is a front view of the essential part of FIG. 24.

FIGS. 24 and 25 show a further modified example of the third embodiment of the present invention, in which the the dents of the reed 2 are formed respectively with generally semicircular cutout portions or grooves 2*b* which serve as air guide channels and therefore air guide members are omitted in this example. A nozzle holder 37 for holding the auxiliary nozzle 18 and the boat-like member 36 is secured at the front surface of the reed holder 11 with a bolt 42. A tapered plate 39 is disposed in contact with the reed frame 2*a*. A wedge-type thrust member 40 is inserted between the tapered plate 39 and the the side wall of the groove of the reed holder 11. The thrust member 40 is fixed in position by screwing up a bolt 41. In this case, it is preferable that the top-most surface of the boat-like member 36 lies in the vicinity of the same level as the lower periphery of the groove 2*b* formed at the dent of the reed 2. An arrow C in FIG. 25 indicates the direction in which air jet is ejected. It is to be noted that, also in this case, a small cylindrical nozzle opening is formed at the auxiliary nozzle 18 so that the extension of the axis of the nozzle opening intersects the axis of an air guide channel formed by the grooves 2*b* at an angle on a plane containing the axes of the nozzle opening and the air guide channel, though not shown.

It will be appreciated from the foregoing that the third embodiment of the present invention will overcome the drawbacks encountered in the following various conventional weft picking devices shown in FIGS. 26 to 28.

Figure 26:
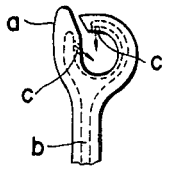
FIG. 26 is a schematic view showing the essential part of a first conventional weft picking device.

A first conventional weft picking device comprises an air guide member a which is shown in FIG. 26, in which a plurality of the air guide members are arranged in the direction of weft picking at certain intervals. The air guide members are formed with air guide openings, respectively, which form an air guide channel through which a weft yarn is picked under the action of an air jet ejected from a main nozzle. In an air jet type weaving loom equipped with such a weft picking device, the air guide member a is formed with a hollow air passage b and ejection openings c communicating with the air passage b, which function as an auxiliary nozzle. However, the thickness of the air guide member a is small and accordingly it is difficult to form the air passage b and the ejection openings c, requiring difficult machining operations. Additionally, after the ejection openings c are once formed, it is impossible to change the direction of the air ejection opening c, so that the direction of air ejection is not variable. Besides, such an air ejection opening c is formed by machining a section whose thickness is about 1 mm, and accordingly it is difficult to precisely set the direction of air ejection.

Figure 27A:
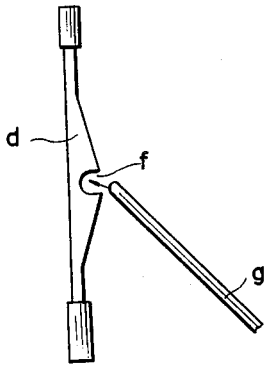
FIGS. 27A and 27B are schematic illustrations showing the essential part of a second conventional weft picking device.
Figure 27B:
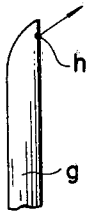

A second conventional weft picking device comprises a plurality of reed members each being indicated at the reference character d. The reed members are formed with grooves f, respectively, which form an air guide channel through which a weft yarn is picked. An auxiliary nozzle g formed with an air ejection opening h is provided so that air from the air ejection opening h is ejected in the direction of an arrow as shown in FIGS. 27A and 27B in an air jet type weaving loom equipped with such a weft picking device. The weft picking is achieved by the air jet from a main nozzle with assistance of the air jet from the auxiliary nozzle. However, in the thus arranged weaving loom, the head section of the auxiliary nozzle is formed into the shape which is parallel with the array of the warp yarns. Therefore, in order to change the ejection direction of air from the auxiliary nozzle, it is necessary to change the mounting angle of the auxiliary nozzle, by which the function of pushing aside the warp yarns is considerably diminished.

Figure 28:
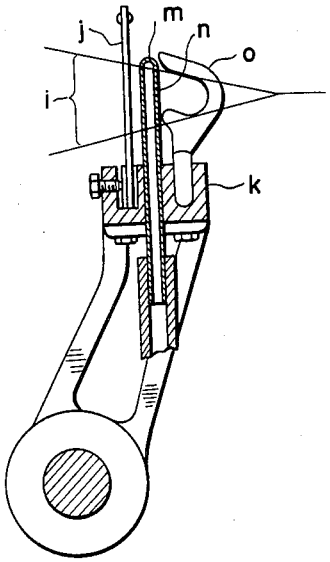
FIG. 28 is a schematic sectional view showing the essential part of a third conventional weft picking device.

A third conventional weft picking device is shown in FIG. 28, which is disclosed in the above-mentioned Japanese Patent Provisional Publication No. 47-7576 and comprises reed members j secured to a reed holder k, an air guide member O, and an auxiliary nozzle formed with an air ejection opening n. The reference character i indicates warp yarns. In this device, the auxiliary nozzle m and the air guide member O are formed separate from each other, and the air guide member O is located nearer than the auxiliary nozzle m relative to the weave front, so that the auxiliary nozzle m enters the array of the warp yarns earlier than the air guide member 4. Accordingly, the auxiliary nozzle m must push aside the warp yarns at its head section, and therefore the head section must be formed into a shape suitable for pushing aside the warp yarns. In other words, the thickness of the head section of the auxiliary nozzle is limited to about 3 mm because of being inserted into the array of the warp yarns. It will be appreciated that it is difficult to precisely set the direction of the nozzle opening formed of such a thin section. Furthermore, it is required to form the head section of the auxiliary nozzle into a flat shape in order to precisely set the direction of the nozzle opening. In this regard, the shape of the auxiliary nozzle unavoidably becomes one similar to the nozzle g shown in FIGS. 27A and 27B and therefore similar difficulties relating to the nozzle in FIGS. 27A and 27B arise in connection with the auxiliary nozzles shown in FIG. 28. Even if the auxiliary nozzle m is formed into the shape of a smoking pipe, it is difficult to form the head section of the auxiliary nozzle into a shape which never damage the warp yarns.

It will be appreciated that all the difficulties encountered in the three typical conventional air jet type weaving looms can be effectively solved by the third embodiment of the present invention which has been shown with reference to FIGS. 14 to 25.

What is claimed is:

1. A weft picking device of an air jet type weaving loom, comprising:

(a) a weft inserting nozzle for injecting a weft yarn under the influence of an air jet therefrom to insert the weft yarn into the shed of warp yarns;

(b) a plurality of air guide members each having a generally looped section defining at the inner peripheral surface thereof an air guide opening, said loop section having a slit through which the weft yarn can leave said air guide opening, said air guide openings forming an air guide channel through which the weft yarn is picked into the warp yarn shed;

(c) an auxiliary nozzle in the shape of a pipe and having a nozzle opening through which an auxiliary air jet is ejected to enhance an air stream produced by the air jet from said weft inserting nozzle so as to assist weft picking, said nozzle opening of said auxiliary nozzle being so formed that the extension of the axis thereof intersects the axis of said air guide channel at a predetermined angle and is perpendicular to a tangent line of said air guide opening of one of said air guide members at a point on said inner peripheral surface of said loop section thereof; and (d) means for pushing aside the warp yarns when said auxiliary nozzle enters the array of warp yarns, said pushing aside means being located in the vicinity of said auxiliary nozzle and the dents of a reed.

2. A weft picking device as claimed in claim 1, further comprising means for adjusting the location of said nozzle opening of said auxiliary nozzle relative to said air guide channel.

3. A weft picking device as claimed in claim 2, wherein said nozzle adjustment means causes rotational and axial movements of said auxiliary nozzle, said movements causing adjustments in the direction and location of the axis of said auxiliary nozzle opening.

4. A weft picking device as claimed in claim 1, in which said loop section of said air guide member is generally circular so that said air guide opening is generally circular.

5. A weft picking device as claimed in claim 1, in which said inner peripheral surface of the said loop section of said air guide member is tapered in the direction away from said weft inserting nozzle.

6. A weft picking device as claimed in claim 1, in which said tangent line of said air guide opening of said air guide member lies on a plane to which the axis of said air guide channel is perpendicular.

7. A weft picking device of an air jet type weaving loom comprising:

(a) a weft inserting nozzle for injecting a weft yarn under the influence of an air jet issuing from said nozzle to insert the weft into the shed of warp yarns;

(b) a plurality of air guide members each having a generally looped section, each said air guide member having at its inner peripheral surface a substantially circular air guide opening, said loop section having a slit formed therein through which the weft yarn can leave said air guide opening, said air guide members being aligned so that said substantially circular air guide openings from an air guide channel through which the weft yarn is picked into the shed of warp yarns;

(c) an auxiliary nozzle in the shape of a pipe disposed between a pair of adjacent air guide members and having a nozzle opening through which an auxiliary air jet is ejected to enhance the air stream produced by said weft inserting nozzle to assist weft picking, said auxiliary nozzle opening being positioned so that the extension of the axis thereof intersects the axis of said air guide channel at a predetermined angle and lies in a plane containing the axes of said auxiliary nozzle opening and said air guide channel, and the axis of said auxiliary nozzle opening is perpendicular to a tangent line of one of said air guide openings at a point on said inner peripheral surface of said loop section; and (d) means for pushing aside the warp yarns when said auxiliary nozzle enters the array of the warp yarns, said means including a boat-like member positioned between said auxiliary nozzle and the dents of the reed, said boat-like member having a ridge extending from its top down its first side which faces the dents of the reed, said boat-like member further having symmetrical smooth surfaces extending from said ridge towards its second side which faces said auxiliary nozzle.

8. A weft picking device as claimed in claims 1 or 7, in which said predetermined angle is within a range of from 10 to 20 degrees.

9. A weft picking device as claimed in claims 1 or 7, in which said auxiliary nozzle is located substantially outside of said air guide channel.

10. A weft picking device as claimed in claim 9, in which at least one air guide member is formed at its inner peripheral surface with a groove which merges in said air guide opening thereof, said at least one air guide member being located farther than said auxiliary nozzle relative to said weft inserting nozzle, whereby the auxiliary air from the nozzle opening of said auxiliary nozzle flows along said groove.

11. A weft picking device as claimed in claim 7, in which the outer diameter of said auxiliary nozzle is smaller than the distance between said symmetrical smooth surfaces of said boat-like member.

12. A weft picking device as claimed in claim 7, in which said boat-like member is so located that its axis is substantially parallel with the axis of said auxiliary nozzle.

13. A weft picking device as claimed in claim 7, in which said boat-like member is formed with a hollow which extends from said first side to said second side, said auxiliary nozzle being located within said hollow.

14. A weft picking device as claimed in claim 13, in which said auxiliary nozzle is so located that its axis angularly crosses the axis of said boat-like member.

15. A weft picking device of an air jet type weaving loom comprising:

(a) a weft inserting nozzle for injecting a weft yarn under the influence of an air jet issuing from said nozzle to insert the weft into the shed of warp yarns;

(b) a plurality of air guide members each having a generally looped section, each said air guide member having at its inner peripheral surface a substantially circular air guide opening, said loop section having a slit formed therein through which the weft yarn can leave said air guide opening, said air guide members being aligned so that said substantially circular air guide openings form an air guide channel through which the weft yarn is picked into the shed of warp yarns;

(c) an auxiliary nozzle in the shape of a pipe disposed between a pair of adjacent air guide members and having a nozzle opening through which an auxiliary air jet is ejected to enhance the air stream produced by said weft inserting nozzle to assist weft picking, said auxiliary nozzle opening being positioned so that the extension of the axis thereof intersects the axis of said air guide channel at a predetermined angle and lies in a plane containing the axes of said auxiliary nozzle opening and said air guide channel, and the axis of said auxiliary nozzle opening is perpendicular to a tangent line of one of said air guide openings at a point on said inner peripheral surface of said loop section; and (d) means for supporting and for repositioning said auxiliary nozzle opening including an air guide member holder having a hole through which said auxiliary nozzle extends and also having a threaded section, a hollow support member disposed in said hole around said auxiliary nozzle, said hollow support member having a slit along its longitudinal axis, said hollow support member having a first tapered section contactable with a corresponding tapered section of said air guide member holder hole, said hollow support member also having a second tapered section, a hollow bolt disposed in said hole around said auxiliary nozzle, said hollow bolt having a tapered section contactable with said support member second tapered section, said hollow bolt having a threaded section engageable with said air guide member holder threaded section.

* * * * *